United States Patent [19]

Banzoli et al.

[11] 3,943,724

[45] Mar. 16, 1976

[54] UNDERWATER STATIONARY TANK FOR STORING LARGE AMOUNTS OF CRUDE OIL

[75] Inventors: Valeriano Banzoli, Mestre; Giovanni De Nora, Spinea; Vincenzo Di Tella, Cappella di Torre Gavetta (Naples); Domenico Lalli, Mogliano Veneto; Gianfranco Tempo, Venezia Lido, all of Italy

[73] Assignee: Tecnomare S.p.A., San Donato Milanese, Italy

[22] Filed: Apr. 11, 1974

[21] Appl. No.: 460,220

[30] Foreign Application Priority Data

Apr. 13, 1973 Italy ..... 22953/73

[52] U.S. Cl. ..... 61/46.5; 114/.5 T

[51] Int. Cl.[2] ..... B65D 86/16

[58] Field of Search ..... 114/.5 T, 74 R, 74 B; 61/46.5, .5; 220/18; 222/386.5, 389, 95; 9/8 P

[56] References Cited

UNITED STATES PATENTS

| | | | |
|---|---|---|---|
| 2,696,185 | 12/1954 | Snoddy | 114/74 R |
| 2,924,350 | 2/1960 | Greer | 220/18 X |
| 3,158,296 | 11/1964 | Cornelius | 222/386.5 |
| 3,540,397 | 11/1970 | Burns | 114/.5 T |
| 3,550,385 | 12/1970 | Lowd et al. | 9/8 P |
| 3,710,582 | 1/1973 | Hills | 114/.5 T |

OTHER PUBLICATIONS

A. Hersent, "New Submarine Storage Reservoirs for Petroleum Products" La Houille Blanche pp. 255–259 Mar. 1970.

*Primary Examiner*—Trygve M. Blix
*Assistant Examiner*—Gregory W. O'Connor
*Attorney, Agent, or Firm*—Ralph M. Watson

[57] ABSTRACT

A submersible oil-storage tank is constructed from a foundation plate which has a flat lower face and a concave upper face and contains a series of hollow cells, a cupola mounted on the foundation plate to form a spheroidal chamber, and extensible-retractable tie members connecting the cupola with the foundation plate. An expansible separating wall extends across the chamber and divides it into a lower sub-chamber and an upper sub-chamber. Each sub-chamber is provided with a valved duct so that water may be permitted to flow into or out of the lower sub-chamber and oil may be permitted to flow into or out of the upper sub-chamber.

3 Claims, 6 Drawing Figures

UNDERWATER STATIONARY TANK FOR STORING LARGE AMOUNTS OF CRUDE OIL

The present invention relates to a submerged tank suitable for storing large amounts of crude oil without polluting the waters surrounding the same.

Underwater stationary tanks for storing large amounts of crude oil are already known, but they are subject to serious drawbacks, such as, the requirement of a long and expensive preparation of the sea-bed to transform it into a suitable seat, high seating costs (sinking of the tank) and the requirement of elements suitable to permit the emptying of the tank.

The underwater stationary tank of the present invention makes it possible to obtain the oil there by means of specific gravity, by making use of the known principle of displacement by water.

The underwater stationary tank of the present invention will be described in greater detail to reference with the accompanying drawings showing a practical embodiment given only by way of example.

Figure 1:
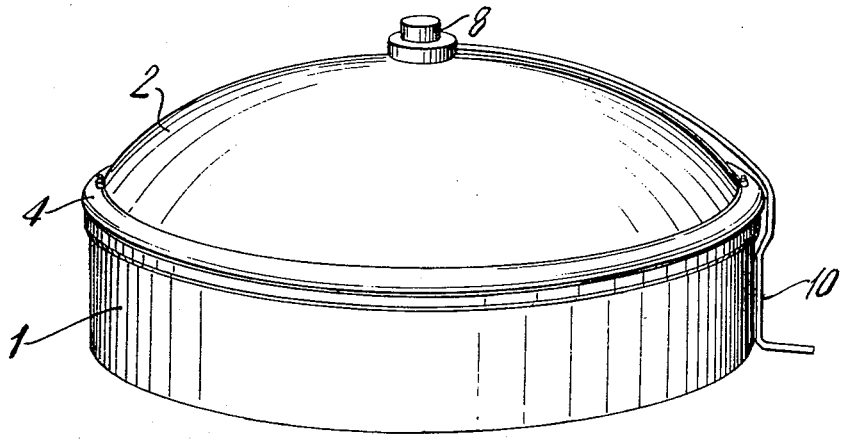
FIG. 1 is a general perspective view of an underwater stationary tank according to the invention.
Figure 2:
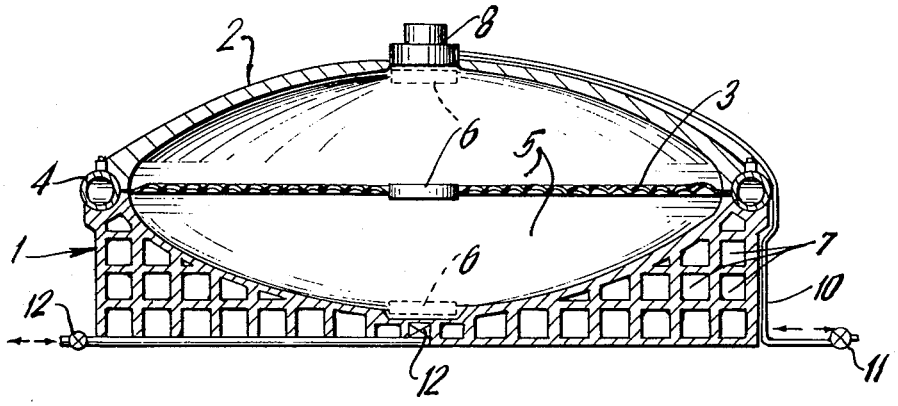
FIG. 2 is a view in vertical cross section of the underwater stationary tank illustrated in FIG. 1.

The underwater stationary tank illustrated in the drawings consists essentially of three main elements (see FIG. 2): the foundation plate or bases 1, the metal cupola 2 and the separating wall 3 adapted to separate crude oil from water. Foundation plate 1 is a planoconcave lens-shaped body, with the concavity turned upside, which may be made of concrete or steel with cells 7 serving to lighten the plate, when empty, in order to allow its transport and, when flooded, to help it to sink. Metal cupola 2 is provided at its periphery with a tight toroidal body 4, which may be flooded, serving to counterbalance the cupola weight in water so as to allow a slow sinking of the same while it is being seated. Separating wall 3, made of rubberized canvas, is an undulating, centrally-symmetrical membrane reinforced by rings and metal ropes. Separating wall 3 is provided at its center with a metallic collector 6 serving to collect paraffins and any solid sediments in the crude oil, and also as a structural reinforcement for separating wall 3. Separating wall 3 may assume, upon expansion, two extreme positions: an upper position in which it is in contact with metal cupola 2 (which it assumes when the tank is filled with water) and a lower position in which it is in contact with foundation plate 1 (which it assumes when the tank is filled with oil).

The tank, when full of crude oil will have, when submerged in water, a total weight suitable to secure it stably on the sea bottom even against strong submarine currents.

Figure 3:
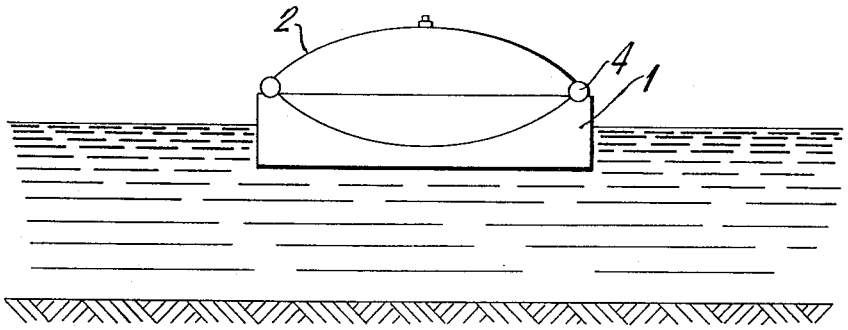
FIGS. 3, 4, 5 and 6 show the successive phases of sinking and locating the underwater stationary tank in place on a submerged bed.
Figure 4:
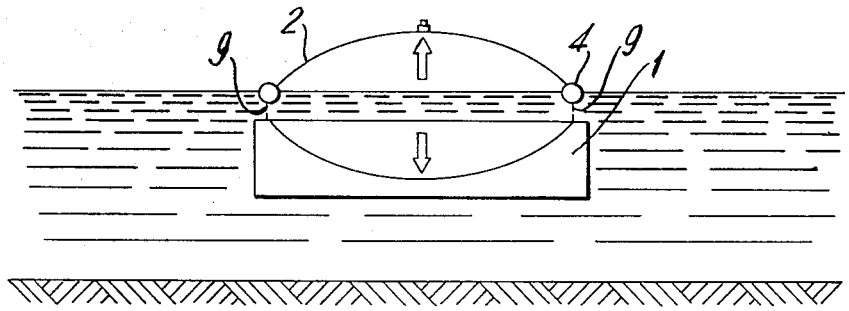

The tank is prefabricated in a yard on land and then, by means of a known technique, is launched and towed to its destination (see FIG. 3) where operations for sinking and seating the tank on the sea bed begin as tie rods 9 are paid out. FIG. 4 shows metal cupola 2 which floats, since it represents a suitable air-bubble type structure. Plate 1 and the relevant membrane 3 are now permitted to sink slowly by extending tie rods 9 which may be extended or retracted by winches (not shown) suitably located on plate 1. Plate 1 may be partially flooded in order to obtain a quicker and more regular sinking.

Figure 5:
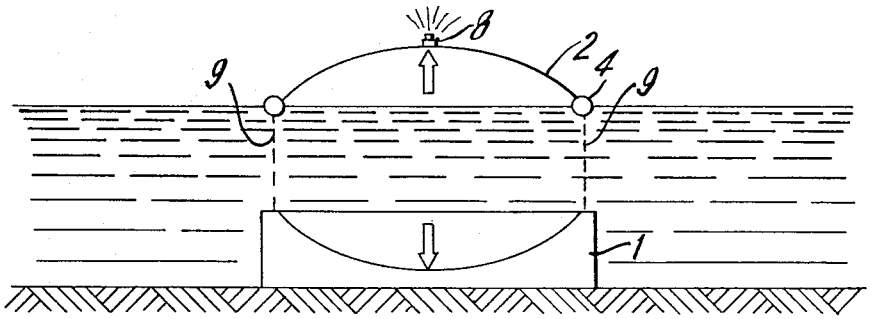

FIG. 5 shows the phase in which plate 1 has reached the bottom and the flooding is total. At this point tie rods 9 are drawn in.

From now on plate 1 acts as an element drawing metal cupola 2 downwards through tie rods 9. During the sinking cupola 2 may be vented by means of suitable valves 8 located at its summit.

Said venting aims to facilitate and stabilize the sinking of cupola 2. The venting valves and the winch elements may be suitably controlled. Since said elements, per se, are not part of the invention they will be described no further.

Figure 6:
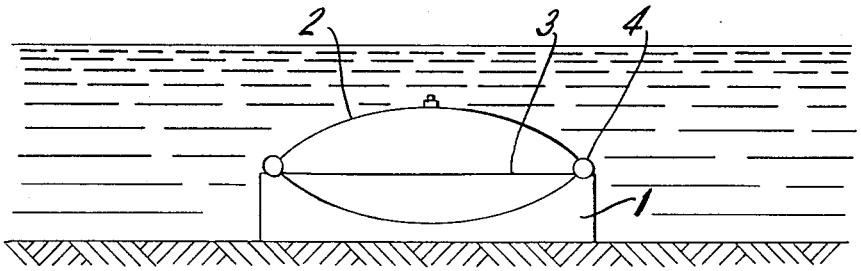

FIG. 6 shows the last phase, the one for coupling cupola 2 and base 1 with membrane 3 in a secure and sealing manner.

The tank can then be used as follows:

Duct 10, leading from a land drilling zone, for example, supplies crude oil to the tank. Said crude oil begins to flood the interior of the cupola and to push downwards separating wall membrane 3 expelling the water existing between membrane 3 and plate 1 through exhaust means 12. Once membrane 3 has reached the concave surface of plate 1 the introduction of crude oil is stopped and the oil is stored in a bi-convex lens-shaped storage volume 5.

When the oil is to be transferred to an oil tanker, in the neighbourhood of the stationary tank, a base from the tanker may be connected with valve or valves 11 having two or more ways. Exhaust means 12 of plate 1 serves also to admit water into the space existing between inside surface of base 1 and separating wall 3, and the loading of the oil tanker begins. In view of the fact that the specific gravity of water is greater than that of crude oil, the pressure of water causes water to be introduced through duct 12 into the space below the separating wall 3 when valve 11 is open, thereby pushing separating wall 3 upwardly and expelling the oil through valve 11.

What we claim is:

1. A submersible tank for the storing of oil under water adapted to be stably positioned on a submerged bed so that it is located beneath the water surface, comprised of a planoconcave lens-shaped foundation plate having a flat lower face and a concave upper face, a cupola adapted to be mounted on said foundation plate to form a spheroidal chamber, an expansible separating wall attached to the foundation plate along its upper edge so that it extends across said spheroidal chamber and divides it into a lower sub-chamber and an upper sub-chamber, a valve adapted to control the flow of water into and out of the lower sub-chamber, a second valve adapted to control the flow of oil into and out of the upper sub-chamber, and extensible and retractable tie means mounted on the foundation plate and adapted to pull the cupola downwards against the foundation plate.

2. A submersible tank for the storing of oil as claimed in claim 1, wherein the foundation plate is provided with a series of cells adapted to contain air and render the foundation buoyant or to contain water and render the foundation plate nonbuoyant.

3. A submersible tank for the storing of oil as claimed in claim 2, wherein the concave upper face of the foundation plate is surrounded by a rim provided with an annular groove, and the cupola has a vent in its top adapted to permit the escape of air and is provided with a hollow torus at its bottom adapted to be seated in said groove and to contain air and render the cupola buoyant or to contain water and render the cupola nonbuoy-ant.

* * * * *

UNITED STATES PATENT AND TRADEMARK OFFICE

CERTIFICATE OF CORRECTION

PATENT NO. : 3,943,724

DATED : March 16, 1976

INVENTOR(S) : Valeriano Banzoli, Giovanni DeNora and Vincenzo DiTella

It is certified that error appears in the above-identified patent and that said Letters Patent are hereby corrected as shown below:

Column 1, line 16, Change "there by" to read --therefrom--;

Column 2, line 31, Change "base" to read --hose--.

Signed and Sealed this

First Day of February 1977

[SEAL]

*Attest:*

RUTH C. MASON
*Attesting Officer*

C. MARSHALL DANN
*Commissioner of Patents and Trademarks*